US007810242B1

(12) United States Patent
Lynch

(10) Patent No.: US 7,810,242 B1
(45) Date of Patent: Oct. 12, 2010

(54) SLICING SCISSORS

(76) Inventor: John Berrien Lynch, 1127 Miami Blvd., Delray Beach, FL (US) 33483-3439

( * ) Notice: Subject to any disclaimer, the term of this patent is extended or adjusted under 35 U.S.C. 154(b) by 38 days.

(21) Appl. No.: 12/011,500

(22) Filed: Jan. 28, 2008

(51) Int. Cl.
*B26B 13/28* (2006.01)
*B26B 13/00* (2006.01)

(52) U.S. Cl. ..... 30/254; 30/259; 30/266

(58) Field of Classification Search ..... 30/254, 30/258, 259, 266
See application file for complete search history.

(56) References Cited

U.S. PATENT DOCUMENTS 280,047 A * 6/1883 Kully ..... 30/259
607,839 A * 7/1898 Elliott ..... 30/259
1,862,079 A * 6/1932 Gilstrap et al. ..... 30/349
2,073,460 A * 3/1937 Vosbikian et al. ..... 30/252
2,249,515 A * 7/1941 Carroll ..... 30/226
4,528,707 A * 7/1985 Aida ..... 7/131
4,982,500 A * 1/1991 Ramani ..... 30/254
5,501,016 A * 3/1996 Kuribayashi ..... 30/260
7,640,666 B1 * 1/2010 Huang ..... 30/234

FOREIGN PATENT DOCUMENTS

DE 3407 117 A1 * 9/1985
JP 3-9782 * 1/1991

* cited by examiner

*Primary Examiner*—Hwei-Siu C Payer
(74) *Attorney, Agent, or Firm*—Oltman, Flynn & Kubler

(57) ABSTRACT

A pair of scissors has first and second cutting panels operationally interconnected with both pins and pin guide slot\s so that the first and second cutting edges of these panels simultaneously pivot and slide longitudinally when closing together onto an item to be cut to enhance the effectiveness of the cutting action.

8 Claims, 6 Drawing Sheets

SLICING SCISSORS

BACKGROUND OF THE INVENTION

1. Field of the Invention

The present invention relates generally to the field of cutting implements such as scissors. More specifically the present invention relates to a pair of scissors including a first cutting panel with a longitudinal first panel abutting face and a first panel distal segment with a first cutting edge and a first panel proximal segment configured as a first handle and a primary fixed pivot pin protruding perpendicularly from the first panel abutting face and located midway between the first panel distal segment and the first panel proximal segment, and a primary arched guide slot spaced proximally from the primary fixed pivot pin and following a path substantially defining a curve which preferably is a segment of an ellipse centered substantially at the primary fixed pivot pin; and including a second cutting panel substantially matching the size of and having substantially the mirror image shape of the first cutting panel and having a second panel abutting face placed in abutting relation to the first panel abutting face and a second panel distal segment with a longitudinal second cutting edge and a second panel proximal segment configured as a second handle and a substantially rectilinear double pivot pin slot extending substantially longitudinally between the second panel proximal and distal segments and registering with and receiving the primary fixed pivot pin which has a pin retaining head at its free end wider than the double pivot pin slot; and a floating guide pin extending through the double pivot pin slot and the primary arched guide slot with opposing pin retaining heads, having diameters greater than the widths of the double pivot pin slot and the primary arched guide slot.

The scissors cut an item placed between the first and second cutting edges by closing angularly onto the item while the first and second cutting panels inventively slide longitudinally relative to each other to enhance the cutting action. The movement of the floating guide pin along the primary arched guide slot constrains the first and second cutting edges to slide longitudinally relative to each other in a first relative direction while rotationally closing together. By the same token, this pin and slot cause the first and second cutting edges to slide back to their original positional relationship in a second relative direction.

The first cutting panel preferably has a secondary guide slot which preferably is arched and following a path substantially defining a curve which preferably is a segment of an ellipse centered substantially at the primary fixed pivot pin but may alternatively be rectilinear as long as it is angled relative to the double pivot pin slot, and the second cutting panel preferably has a fixed secondary guide pin extending substantially perpendicularly from the second cutting panel abutting face and located to register with and fit through the secondary guide slot to add structural and item cutting strength to the scissors. Either the primary guide slot or the secondary guide slot can be omitted and the scissors will function as intended and described.

2. Description of the Prior Art

There have long been pairs of scissors for cutting sheet material, cords and strings and other items. These conventional scissors include cutting blades interconnected by a pivot pin to pivot circumferentially in fixed rotational relation about the pivot pin and thereby close against and cut the item. A problem with this cutting action is that it relies entirely on compression of the converging blade edges against the item which may be of a material or of a shape which does not lend itself to easy cutting in this way.

It is thus an object of the present invention to provide a pair of scissors which combines the compression cutting action of converging cutting edges with a simultaneous sliding cutting action in which one cutting edge slides longitudinally with respect to the other.

It is another object of the present invention to provide a pair of scissors which are used and handled in the very same easy way that conventional scissors are used and handled.

It is finally an object of the present invention to provide a pair of scissors which are sturdy, reliable, and economical to manufacture.

SUMMARY OF THE INVENTION

The present invention accomplishes the above-stated objectives, as well as others, as may be determined by a fair reading and interpretation of the entire specification.

A pair of scissors is provided, including a first cutting panel with a first panel abutting face and a first panel distal segment with a first cutting edge and a first panel proximal segment configured as a first handle, and a fixed pivot pin protruding perpendicularly from the first panel abutting face and located midway between the first panel distal segment and the first panel proximal segment, and a primary arched guide slot spaced from the fixed pivot pin and following a path substantially defining a curve which preferably is a segment of an ellipse centered substantially at the fixed pivot pin; and a second cutting panel substantially matching the size of and having substantially the mirror image shape of the first cutting panel and having a second panel abutting face placed in abutting relation to the first panel abutting face and a second panel distal segment with a second cutting edge and a second panel proximal segment configured as a second handle and a substantially rectilinear double pivot pin slot extending substantially longitudinally between the second cutting panel proximal and distal segments and registering with and receiving the fixed pivot pin which has a second panel retaining structure for retaining the second cutting panel abutting face in abutting relation with the first cutting panel abutting face; and a floating guide pin extending through the double pivot pin slot and the primary arched guide slot with a floating guide pin retaining structure for retaining the floating guide pin in the double pivot pin slot and the primary arched guide slot; so that the scissors cut an item placed between the first and second cutting edges by closing angularly onto the item to be cut while the first and second cutting edges slide longitudinally relative to each other to enhance the cutting action.

The first cutting panel preferably additionally includes a secondary guide slot following a path substantially defining a curve centered substantially at the fixed pivot pin, and the second cutting panel preferably additionally includes a fixed secondary guide pin extending substantially perpendicularly from the second cutting panel abutting face and located to register with and fit through the secondary guide slot, and having a secondary guide pin head protruding at fixed secondary guide pin free end which is wider than the secondary guide slot. The curve of each of the primary guide slot and the secondary guide slot preferably is substantially a segment of an ellipse. Each of the first handle and the second handle preferably is shaped to substantially define an elliptical loop. The second handle preferably is shaped to substantially define an elliptical loop.

A pair of scissors is further provided, including a first cutting panel with a first panel abutting face and a first panel distal segment with a first cutting edge and a first panel proximal segment configured as a first handle, and a fixed pivot pin protruding perpendicularly from the first panel abutting face and located midway between the first panel distal segment and the first panel proximal segment, and a primary arched guide slot spaced proximally from the fixed pivot pin and following a path substantially defining a curve which preferably is a segment of an ellipse centered substantially at the fixed pivot pin; and a second cutting panel substantially matching the size of and having substantially the mirror image shape of the first cutting panel and having a second panel abutting face placed in abutting relation to the first panel abutting face and a second panel distal segment with a second cutting edge and a second panel proximal segment configured as a second handle and a substantially rectilinear double pivot pin slot extending substantially longitudinally between the second cutting panel proximal and distal segments and registering with and receiving the primary fixed pivot pin which has a pin retaining head at its free end wider than the double pivot pin slot; and a floating guide pin extending through the double pivot pin slot and the primary arched guide slot with opposing pin retaining heads having diameters greater than the widths of the corresponding adjacent the double pivot pin slot and the primary arched guide slot; so that the scissors cut an item placed between the first and second cutting edges by closing angularly onto the item to be cut while the first and second cutting edges slide longitudinally relative to each other to enhance the cutting action.

BRIEF DESCRIPTION OF THE DRAWINGS

Various other objects, advantages, and features of the invention will become apparent to those skilled in the art from the following discussion taken in conjunction with the following drawings, in which.

Prior Art

DETAILED DESCRIPTION OF THE PREFERRED EMBODIMENTS

Figure 2:
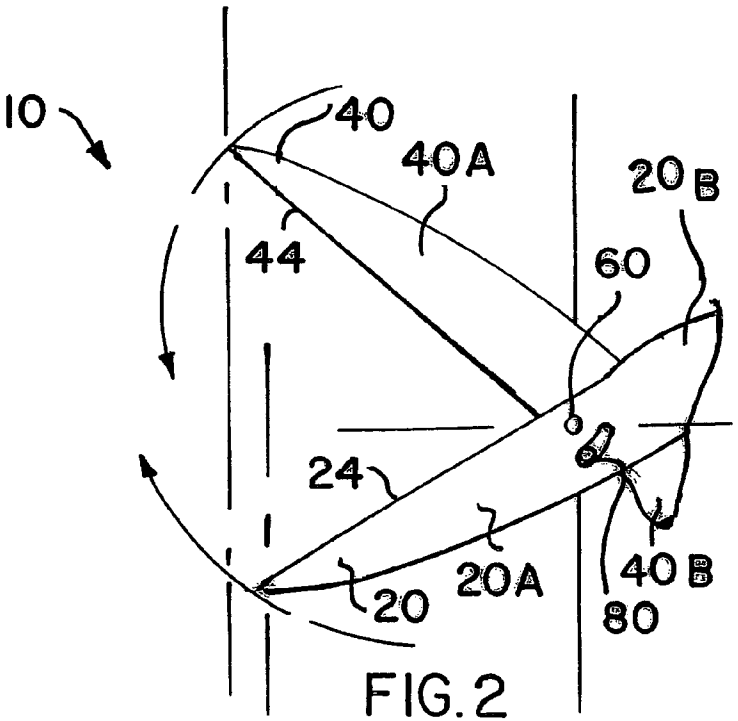
FIG. 2 is a view as in FIG. 1 of a representation of the present invention, showing the simultaneous pivoting and sliding movements of the cutting edges along a non-circular path.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 1:
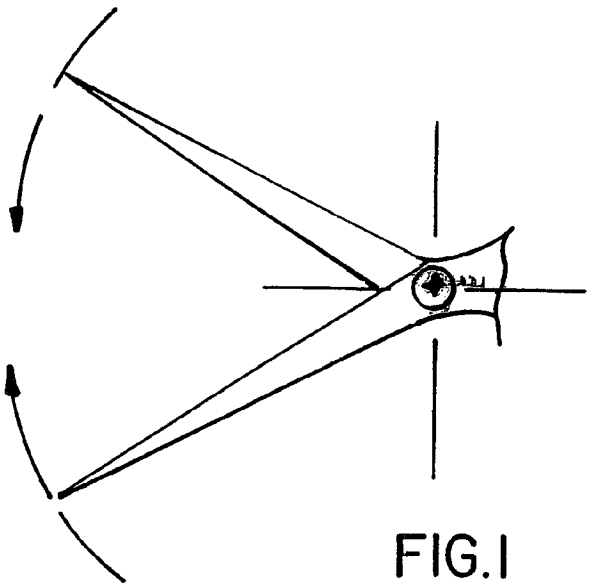
FIG. 1 PRIOR ART
FIG. 1 is a broken away side view of a conventional pair of scissors with the handles omitted, showing the single pivot point circular cutting edge movement which provides no sliding cutting action.
Figure 3:
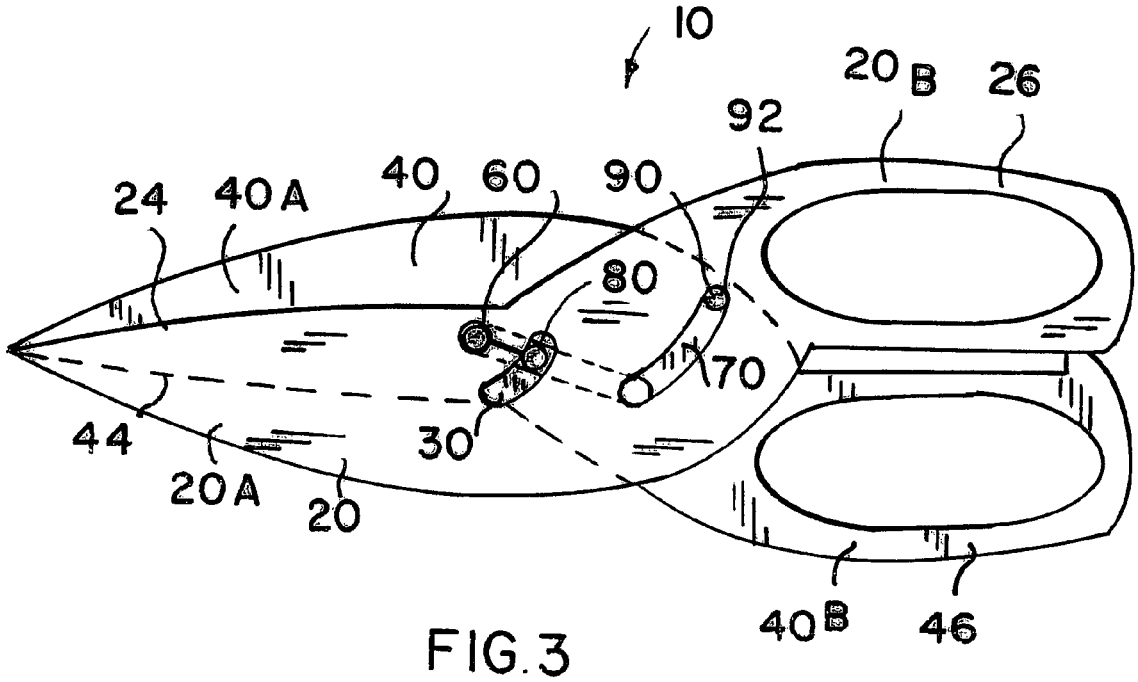
FIG. 3 is a full side view of the present pair of scissors having the inventive pivoting and sliding cutting action.
Figure 4:
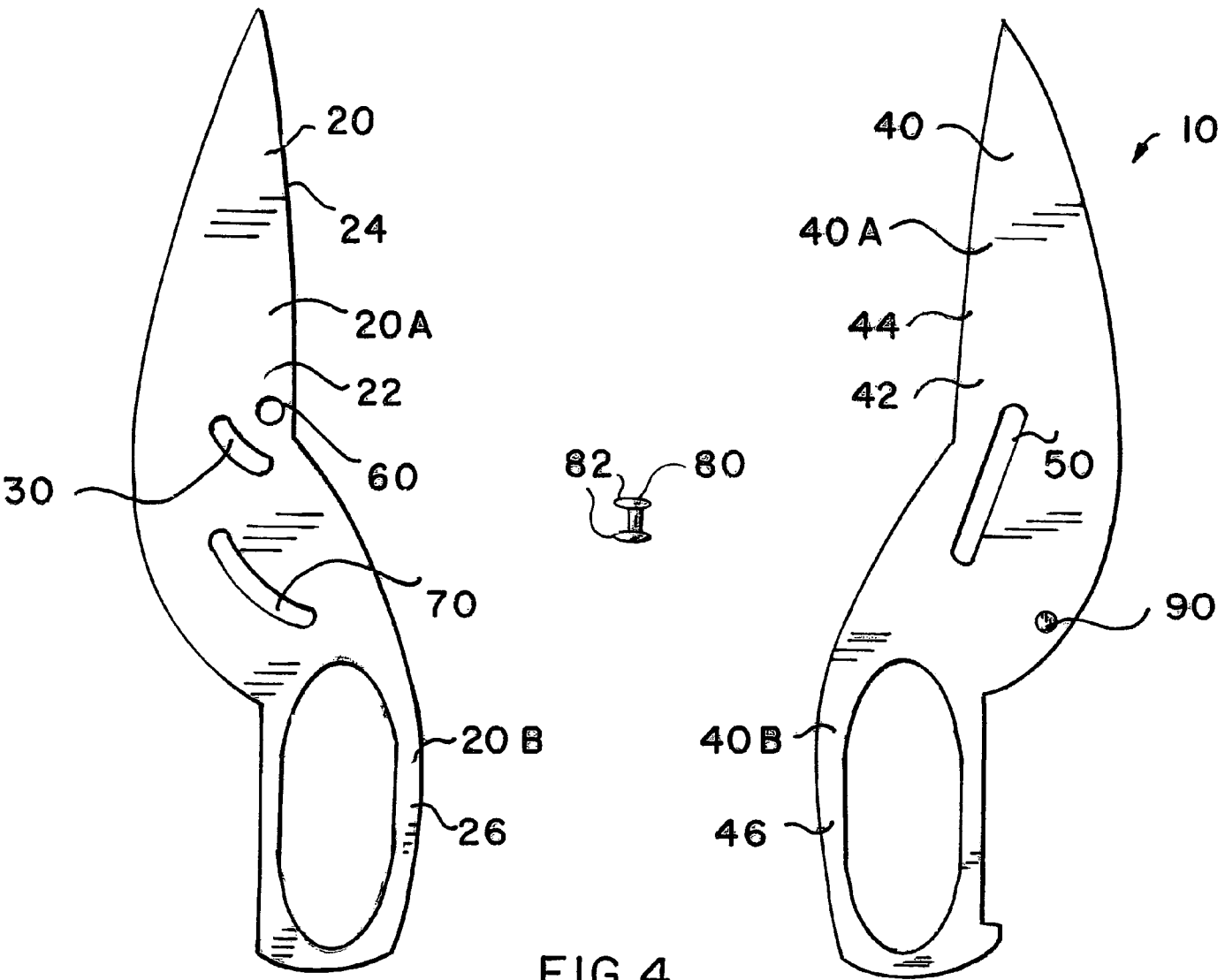
FIG. 4 is an exploded side view of the scissors of FIG. 3 showing separately the first cutting panel, the floating guide pin and the second cutting panel.
Figure 5:
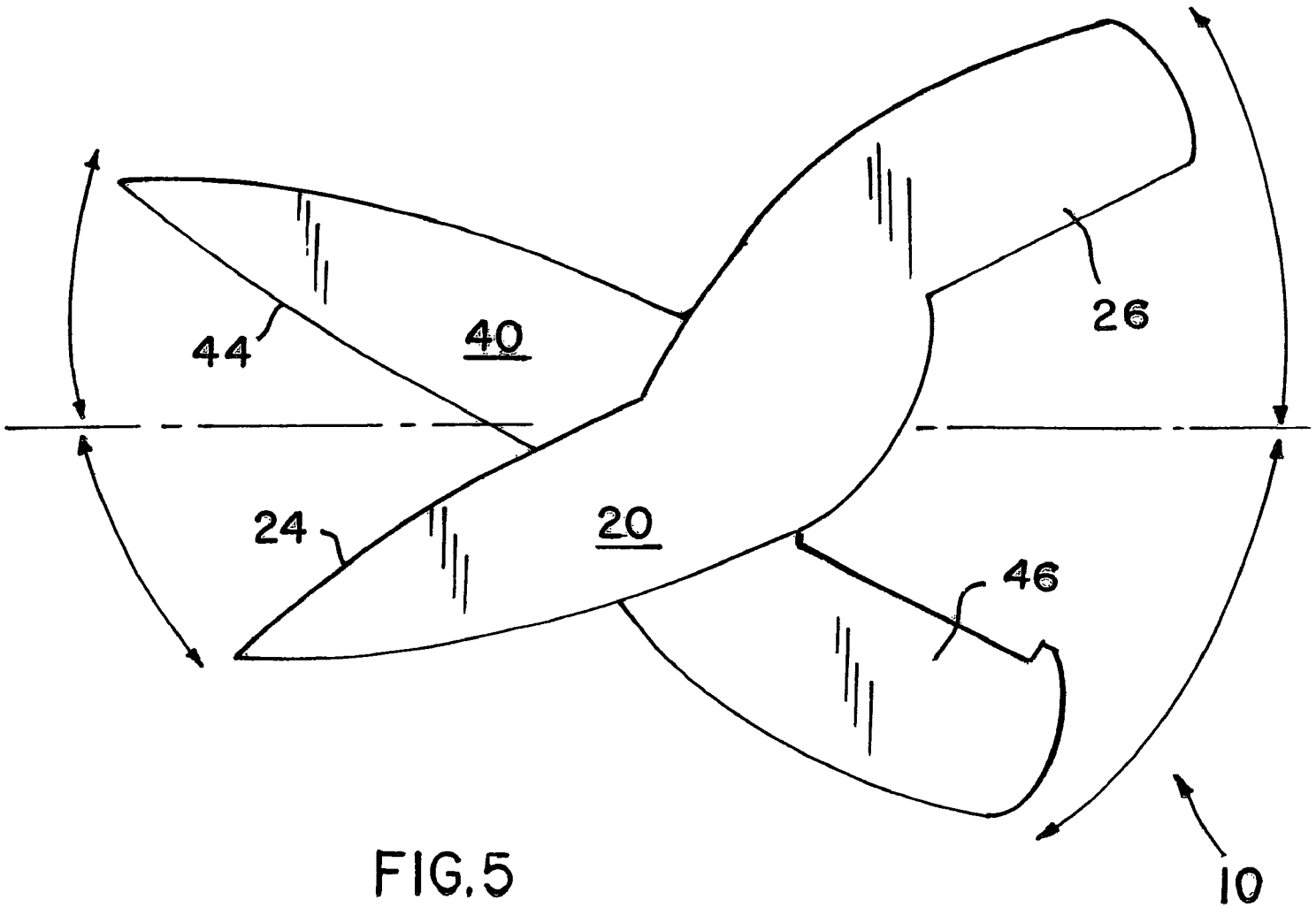
FIG. 5 is a full schematic representation of the present invention, further showing the simultaneous pivoting and sliding movements of the cutting edges along a non-circular path.
Figure 6:
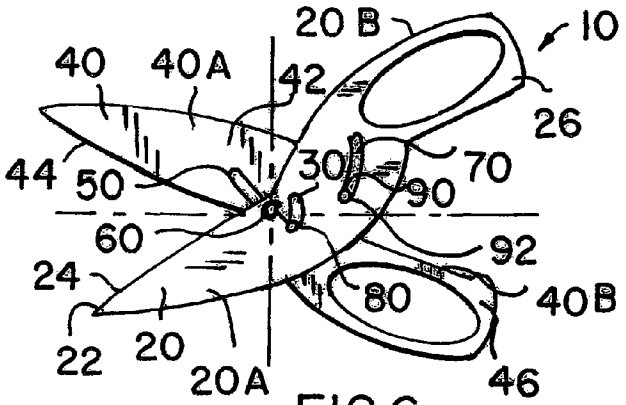
FIG. 6 is the first in a series of five side views of the present scissors as shown in FIG. 3, showing the relationships of the first and second cutting panels as the cutting edges are advanced from an open and separated relationship to close together until the first and second panel abutting faces ultimately reach maximum abutting relation.
Figure 7:
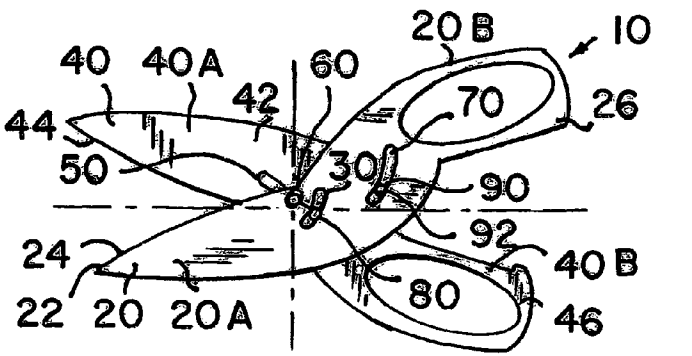
FIG. 7 is the second in a series of five side views as described in the description of FIG. 6.
Figure 8:
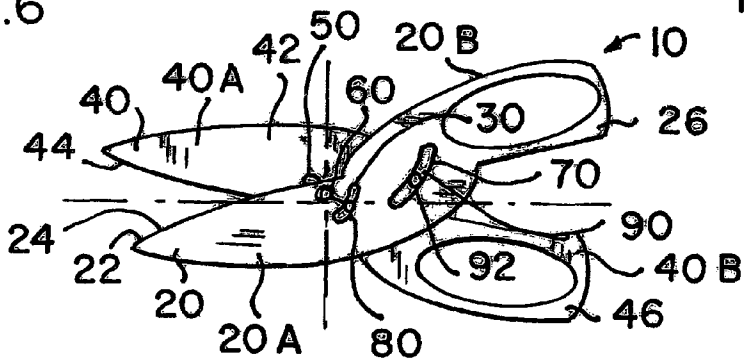
FIG. 8 is the third in a series of five side views as described in the description of FIG. 6.
Figure 10:
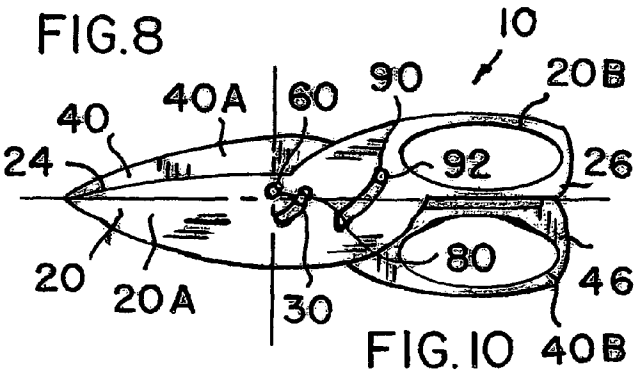
FIG. 10 is the fifth in a series of five side views as described in the description of FIG. 6.
Figure 9:
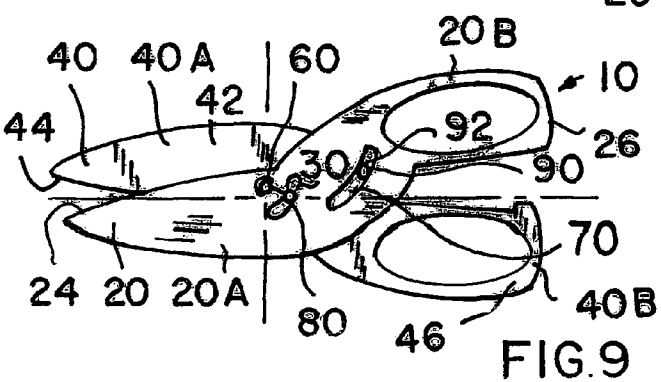
FIG. 9 is the fourth in a series of five side views as described in the description of FIG. 6.
Figure 11:
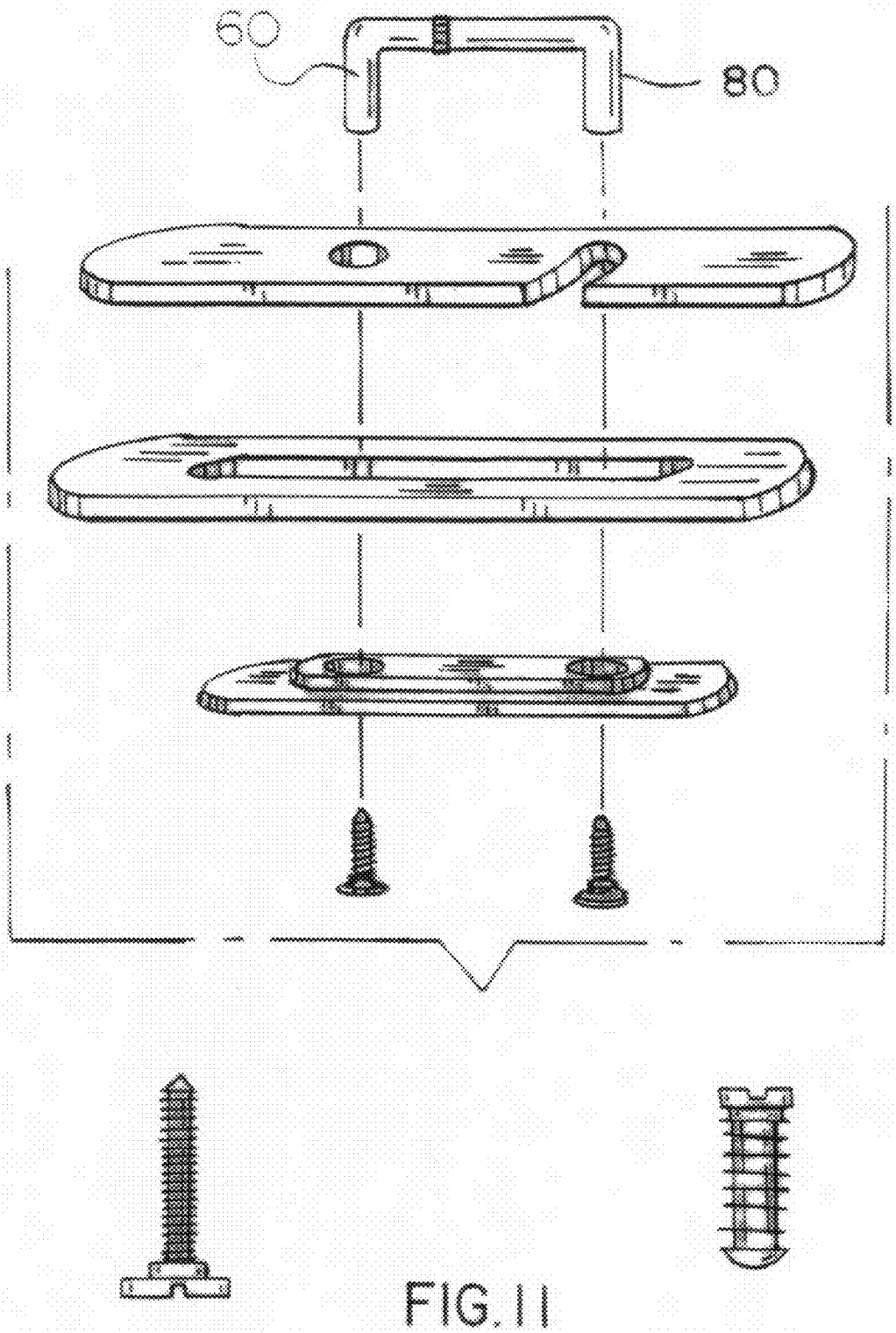
FIG. 11 is an exploded view of a preferred pin assembly for the scissors, including the primary fixed pivot pin.

Referring to FIGS. 1-11, a pair of scissors 10 is disclosed including a first cutting panel 20 with a first panel abutting face 22 and a first panel distal segment 20A with a longitudinal first cutting edge 24 and a first panel proximal segment 20B configured as a first handle 26 and a primary fixed pivot pin 60 protruding perpendicularly from the first panel abutting face 22 and located midway between the first panel distal segment 20A and the first panel proximal segment 20B and a primary arched guide slot 30 spaced proximally from the primary fixed pivot pin 60 and following a path substantially defining a curve which preferably is a segment of an ellipse centered substantially at the primary fixed pivot pin 60; and including a second cutting panel 40 substantially matching the size of and having substantially the mirror image shape of the first cutting panel 20 and having a second panel abutting face 42 placed in abutting relation to the first panel abutting face 22 and a second panel distal segment 40A with a longitudinal second cutting edge 44 and a second panel proximal segment 40B configured as a second handle 46 and a substantially rectilinear double pivot pin slot 50 extending substantially longitudinally between the second panel distal and proximal segments 40A and 40B and registering with and receiving the primary fixed pivot pin 60; which has second panel retaining means in the form of a pin retaining head 62 at its free end which is wider than the double pivot slot 50 for retaining the second cutting panel abutting face in abutting relation with the first cutting panel abutting face. Scissors 10 further includes a floating guide pin 80 extending through the double pivot pin slot 50 and the primary arched guide slot 30 with floating guide pin retaining means in the form of retaining heads 82 having diameters greater than the widths of the double pivot pin slot 50 and the primary arched guide slot 30 for retaining the floating guide pin 80 in the double pivot pin slot 50 and the primary arched guide slot 30.

The scissors 10 cut an item placed between the first and second cutting edges 24 and 44 by closing angularly onto the item while the first and second cutting panels 20 and 40 inventively slide longitudinally relative to each other to enhance the cutting action. The movement of the floating guide pin 80 along the primary arched guide slot 30 constrains the first and second cutting edges 24 and 44 to slide longitudinally relative to each other in a first relative direction while rotationally closing together. By the same token, this pin 80 and slot 30 cause the first and second cutting edges 24 and 44 to slide back to their original positional relationship in a second relative direction.

The first cutting panel 20 preferably has a secondary guide slot 70 following a path substantially defining a curve which preferably is a segment of an ellipse centered substantially at the primary fixed pivot pin 60 but may alternatively be rectilinear as long as it is angled relative to the double pivot pin slot, and the second cutting panel 40 preferably has a fixed secondary guide pin 90 extending substantially perpendicularly from the second cutting panel abutting face 42 and located to register with and fit through the secondary guide slot 70, and having a secondary guide pin head 92 at its free end which is wider than the secondary guide slot 70. The first handle and second handle 26 and 46 respectively preferably each are configured as an elliptical loop, such as are found on conventional scissors.

Either the primary guide slot 30 or the secondary guide slot 70 can be omitted and the scissors 10 will function as intended and described. Retaining heads 82 and guide pin head 92 are optionally rest or ride within recesses in the outward faces of first and second cutting panels 20 and 40 to be substantially flush with the outward faces. The primary arched guide slot 30, the double pivot pin slot 50 and the secondary guide slot 70 alternatively may be grooves or channels in first and second panel abutting faces 22 and 42, and the word slot is defined in this application to include groove or channel.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A pair of scissors, comprising:

a first cutting panel with a first panel abutting face and a first panel distal segment with a first cutting edge and a first panel proximal segment configured as a first handle, and a fixed pivot pin protruding perpendicularly from said first panel abutting face and located midway between said first panel distal segment and said first panel proximal segment, and a primary arched guide slot spaced from said fixed pivot pin and following a path substantially defining a curve which is a segment of an ellipse centered substantially at said fixed pivot pin; and a second cutting panel substantially matching the size of and having substantially the mirror image shape of said first cutting panel and having a second panel abutting face placed in abutting relation to said first panel abutting face and a second panel distal segment with a second cutting edge and a second panel proximal segment configured as a second handle and a substantially rectilinear double pivot pin slot extending substantially longitudinally between said second panel proximal and distal segments and registering with and receiving said fixed pivot pin which has second panel retaining means for retaining said second panel abutting face in abutting relation with said first panel abutting face;

and a floating guide pin extending through said double pivot pin slot and said primary arched guide slot with floating guide pin retaining means for retaining said floating guide pin in said double pivot pin slot and said primary arched guide slot; such that said scissors cut an item placed between said first and second cutting edges by closing angularly onto the item to be cut while said first and second cutting edges slide longitudinally relative to each other to enhance the cutting action.

2. The pair of scissors of claim 1, wherein said first cutting panel additionally comprises a secondary guide slot following a path substantially defining a curve centered substantially at said fixed pivot pin, and wherein said second cutting panel additionally comprises a fixed secondary guide pin extending substantially perpendicularly from said second cutting panel abutting face and located to register with and fit through said secondary guide slot, and having a secondary guide pin head protruding at a free end of said second guide pin which is wider than said secondary guide slot.

3. The pair of scissors of claim 1, wherein said curve of said primary guide slot is substantially a segment of an ellipse.

4. The pair of scissors of claim 2, wherein said curve of said secondary guide slot is substantially a segment of an ellipse.

5. The pair of scissors of claim 1, wherein said first handle is shaped to substantially define an elliptical loop.

6. The pair of scissors of claim 1, wherein said second handle is shaped to substantially define an elliptical loop.

7. A pair of scissors, comprising:

a first cutting panel with a first panel abutting face and a first panel distal segment with a first cutting edge and a first panel proximal segment configured as a first handle, and a fixed pivot pin protruding perpendicularly from said first panel abutting face and located midway between said first panel distal segment and said first panel proximal segment, and a primary arched guide slot spaced proximally from said fixed pivot pin and following a path substantially defining a curve which is a segment of an ellipse centered substantially at said fixed pivot pin; and a second cutting panel substantially matching the size of and having substantially the mirror image shape of said first cutting panel and having a second panel abutting face placed in abutting relation to said first panel abutting face and a second panel distal segment with a second cutting edge and a second panel proximal segment configured as a second handle and a substantially rectilinear double pivot pin slot extending substantially longitudinally between said second panel proximal and distal segments and registering with and receiving said fixed pivot pin which has a pin retaining head at its free end wider than said double pivot pin slot;

and a floating guide pin extending through said double pivot pin slot and said primary arched guide slot with opposing pin retaining heads having diameters greater than the widths of the corresponding adjacent said double pivot pin slot and said primary arched guide slot; such that said scissors cut an item placed between said first and second cutting edges by closing angularly onto the item to be cut while said first and second cutting edges slide longitudinally relative to each other to enhance the cutting action.

8. A pair of scissors, comprising:

a first cutting panel with a first panel abutting face and a first panel distal segment with a first cutting edge and a first panel proximal segment configured as a first handle, and a fixed pivot pin protruding perpendicularly from said first panel abutting face and located midway between said first panel distal segment and said first panel proximal segment, and a guide slot spaced from said fixed pivot pin; and a second cutting panel substantially matching the size of and having substantially the mirror image shape of said first cutting panel and having a second panel abutting face placed in abutting relation to said first panel abutting face and a second panel distal segment with a second cutting edge and a second panel proximal segment configured as a second handle and a substantially rectilinear double pivot pin slot extending substantially longitudinally between said second panel proximal and distal segments at an intersecting angle relative to said guide slot and registering with and receiving said fixed pivot pin which has second panel retaining means for retaining said second panel abutting face in abutting relation with said first panel abutting face;

and a floating guide pin extending through said double pivot pin slot and said guide slot with floating guide pin retaining means for retaining said floating guide pin in said double pivot pin slot and said guide slot; such that said scissors cut an item placed between said first and second cutting edges by closing angularly onto the item to be cut while said first and second cutting edges slide longitudinally relative to each other to enhance the cutting action.

* * * * *